US009826319B2

(12) United States Patent
Künzle et al.

(10) Patent No.: US 9,826,319 B2
(45) Date of Patent: Nov. 21, 2017

(54) HEARING DEVICE COMPRISING A FEEDBACK CANCELLATION SYSTEM BASED ON SIGNAL ENERGY RELOCATION

(71) Applicants: Oticon A/S, Smørum (DK); Bernafon AG, Berne (CH)

(72) Inventors: Bernhard Künzle, Berne (CH); Meng Guo, Smørum (DK)

(73) Assignees: OTICON A/S, Smorum (DK); BERNAFON AG, Berne (CH)

( * ) Notice: Subject to any disclaimer, the term of this patent is extended or adjusted under 35 U.S.C. 154(b) by 0 days.

(21) Appl. No.: 15/257,295

(22) Filed: Sep. 6, 2016

(65) Prior Publication Data

US 2017/0070827 A1 Mar. 9, 2017

(30) Foreign Application Priority Data

Sep. 7, 2015 (EP) ..... 15184008

(51) Int. Cl.
*H04R 25/00* (2006.01)
*H04R 1/10* (2006.01)

(52) U.S. Cl.
CPC ..... *H04R 25/453* (2013.01); *H04R 25/356* (2013.01); *H04R 1/1041* (2013.01); *H04R 2225/43* (2013.01)

(58) Field of Classification Search
CPC ..... H04R 25/30; H04R 25/70; H04R 25/453
(Continued)

(56) References Cited

U.S. PATENT DOCUMENTS 6,072,884 A * 6/2000 Kates ..... H04R 25/453 381/318
6,137,888 A * 10/2000 McClennon ..... H04R 3/00 381/315

(Continued)

FOREIGN PATENT DOCUMENTS

EP 2 148 527 A1 1/2010
EP 2 237 573 A1 10/2010

*Primary Examiner* — Gerald Gauthier
(74) *Attorney, Agent, or Firm* — Birch, Stewart, Kolasch & Birch, LLP

(57) ABSTRACT

A hearing device, e.g. a hearing aid, is provided, comprising a forward path comprising an input transducer for providing an electric input signal, a signal processing unit configured to apply a requested forward gain to the electric input signal, and an output transducer. The hearing device further comprises a feedback reduction unit for reducing a risk of howl due to feedback from the output transducer to the input transducer. The forward path and the external feedback path defines a roundtrip loop delay. The feedback reduction unit is configured to modulate said requested forward gain in time, to provide that the resulting forward gain exhibits a first, increased gain $A_H$ in a first time period $T_H$ and a second, reduced gain $A_L$ in a second time period $T_L$, wherein at least one of $A_H$, $A_L$, $T_H$, and $T_L$ is/are determined according to a predetermined or adaptively determined criterion including said roundtrip loop delay.

18 Claims, 8 Drawing Sheets

(58) Field of Classification Search
USPC .... 381/60, 71.11, 71.8, 94.2, 313, 315, 317, 381/318, 320, 321; 600/57; 700/97
See application file for complete search history.

(56) References Cited

U.S. PATENT DOCUMENTS 6,219,427 B1 * 4/2001 Kates ..... H04R 25/453 381/312
7,245,732 B2 * 7/2007 Jorgensen ..... H04R 25/453 381/317
8,442,247 B2 * 5/2013 Lamm ..... H04R 25/558 381/23.1
8,554,350 B2 * 10/2013 Keady ..... H04R 25/654 700/118
9,615,184 B2 * 4/2017 Guo ..... H04R 25/70
9,635,469 B2 * 4/2017 Lunner ..... A61B 5/04845
2001/0002930 A1 * 6/2001 Kates ..... H04R 25/453 381/317
2002/0094100 A1 * 7/2002 Kates ..... H04R 25/356 381/318
2005/0047620 A1 * 3/2005 Fretz ..... H04R 25/453 381/318
2006/0140429 A1 * 6/2006 Klinkby ..... H04R 25/453 381/317
2006/0291681 A1 * 12/2006 Klinkby ..... H04R 25/453 381/318
2008/0273728 A1 * 11/2008 Klinkby ..... H04R 25/453 381/318
2009/0028366 A1 * 1/2009 Tklinkby ..... H04R 25/453 381/318
2010/0128911 A1 * 5/2010 Elmedyb ..... H04R 25/453 381/320
2010/0183164 A1 * 7/2010 Elmedyb ..... H04R 25/453 381/71.8
2010/0232634 A1 * 9/2010 Boldt ..... H04R 25/453 381/318
2010/0254555 A1 * 10/2010 Elmedyb ..... H04R 25/453 381/318
2011/0026725 A1 * 2/2011 Kunzle ..... G10L 21/0208 381/71.11
2011/0064252 A1 3/2011 Ma et al.
2011/0311075 A1 * 12/2011 Elmedyb ..... H04R 25/453 381/94.2
2013/0101128 A1 * 4/2013 Lunner ..... H04R 25/30 381/60
2013/0170660 A1 * 7/2013 Kristensen ..... H04R 25/305 381/60
2013/0188796 A1 * 7/2013 Kristensen ..... H04R 25/453 381/60
2014/0072156 A1 * 3/2014 Kwon ..... H04R 25/453 381/318
2014/0185846 A1 * 7/2014 Gran ..... H04R 25/405 381/313
2014/0185849 A1 * 7/2014 Ma ..... H04R 25/453 381/318
2014/0348360 A1 * 11/2014 Gran ..... H04R 25/50 381/318
2015/0011266 A1 1/2015 Feldt et al.
2015/0163602 A1 * 6/2015 Pedersen ..... H04R 25/554 381/315
2015/0350794 A1 * 12/2015 Pontoppidan ..... H04R 25/00 381/321
2016/0038738 A1 * 2/2016 Naylor ..... A61N 1/0541 607/57
2016/0057548 A1 * 2/2016 Wurzbacher ..... H04R 25/45 381/315
2016/0119728 A1 * 4/2016 Guo ..... H04R 25/558 381/60
2017/0070827 A1 * 3/2017 Guo ..... H04R 25/356
2017/0078804 A1 * 3/2017 Guo ..... H04R 3/02
2017/0164122 A1 * 6/2017 Guo ..... H04R 25/453

* cited by examiner

HEARING DEVICE COMPRISING A FEEDBACK CANCELLATION SYSTEM BASED ON SIGNAL ENERGY RELOCATION

TECHNICAL FIELD

The present application relates to audio processing in hearing devices, e.g. hearing aids. The disclosure relates specifically to the topic of acoustic or mechanical feedback from an output to an input transducer and in particular to the reduction or elimination of such feedback. In an aspect, the disclosure relates to a hearing device. The application furthermore relates to a method of operating a hearing device and to the use of a hearing device.

The application further relates to a data processing system comprising a processor and program code means for causing the processor to perform at least some of the steps of the method.

Embodiments of the disclosure may e.g. be useful in applications such as hearing aids, headsets, ear phones, active ear protection systems, handsfree telephone systems, mobile telephones, teleconferencing systems, public address systems, karaoke systems, classroom amplification systems, etc.

BACKGROUND

The present disclosure relates to the well-known acoustic feedback problem in audio systems comprising a forward path for amplifying an input sound from the environment picked up by an acoustic input transducer and an output transducer for presenting an amplified version of the input signal as an output sound to the environment, e.g. to one or more users.

Acoustic feedback occurs because the output transducer (e.g. loudspeaker) signal from an audio system providing amplification of a signal picked up by an input transducer (e.g a microphone) is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem appears typically when the microphone and the loudspeaker are placed closely together, as e.g. in hearing aids or other audio systems. Some other classic situations with feedback problem are telephony, public address systems, headsets, audio conference systems, etc. Feedback cancellation (or reduction) is typically provided by subtracting an estimate of the feedback signal from the input signal to provide a feedback corrected input signal. Adaptive feedback estimation has the ability to track feedback path changes over time. It is based on a linear time invariant filter to estimate the feedback path but its filter weights are updated over time. The filter update may be calculated using stochastic gradient algorithms, e.g. including some form of the Least Mean Square (LMS) or the Normalized LMS (NLMS) algorithms. They both have the property to minimize an error signal (e.g. the feedback corrected input signal) in the mean square sense, with the NLMS additionally normalizing the filter update with respect to the squared Euclidean norm of some reference signal (e.g. the output signal). The success of the above mentioned method is dependent on its ability to provide an up to date feedback path estimate in a dynamic acoustic environment (including to be able to distinguish between tonal components originating from the environment and tonal components due to feedback). It may be a challenge to control the adaptation rate of an adaptive algorithm to follow the dynamics of the acoustic environment.

EP2148527A1 deals with a hearing aid system comprising left and right hearing aid devices for completely eliminating the acoustic feedback by using inter-aural signal transmission (cross-over of respective microphone signals to the opposite device) and application of binary (complementary) gain patterns in the respective hearing aid devices.

US2015011266A1 deals with a speakerphone for use in a teleconference setup wherein a complementary filtering scheme is applied in the microphone and loudspeaker paths, respectively.

SUMMARY

This present disclosure provides a stand-alone solution to deal with the acoustic feedback problem, but it can also be used in combination with other known feedback control systems, e.g. a feedback cancellation system comprising an adaptive filter for estimating a current external feedback path.

An object of the present application is provide an alternative scheme for reducing or eliminating external feedback in a hearing device.

Objects of the application are achieved by the invention described in the accompanying claims and as described in the following.

A Hearing Device:

In an aspect of the present application, an object of the application is achieved by a hearing device, e.g. a hearing aid, comprising an input transducer for converting an input sound to an electric input signal representing sound, an output transducer for converting a processed electric output signal to an output sound or mechanical vibration, and a signal processing unit operationally coupled to the input and output transducers and configured to apply a requested forward gain to the electric input signal or a signal originating therefrom, the input transducer, the signal processing unit and the output transducer forming part of a forward path of the hearing device. The forward path applies a resulting forward gain to the electric input signal and provides a resulting signal. The hearing device further comprises a feedback reduction unit for reducing a risk of howl due to acoustic or mechanical feedback of an external feedback path from the output transducer to the input transducer. The forward path and the external feedback path defines a loop path exhibiting a roundtrip loop delay. The feedback reduction unit is configured to modulate the requested forward gain in time to provide that the resulting forward gain exhibits a first, increased gain $A_H$ in a first time period $T_H$ and a second, reduced gain $A_L$ in a second time period $T_L$, wherein at least one of the first gain $A_H$, the second gain $A_L$, the first time period $T_H$, and the second time period $T_L$ is/are determined according to a predetermined or adaptively determined criterion.

Thereby a reduction or elimination of external feedback can be provided.

The terms 'the first, increased gain $A_H$' and 'the second, reduced gain $A_L$' are intended to mean increased and reduced, respectively, relative to the requested gain (at a given point in time (in a time-domain representation) or at a given point in time and frequency (in a time-frequency representation)). The term 'the requested gain' is in the present context taken to mean the gain that is to be applied to the electric input signal to provide an intended amplification of the electric input signal (e.g. to compensate for a user's hearing impairment and/or to compensate for a noisy environment, etc.).

In general, the feedback reduction unit is configured to modulate the requested frequency dependent forward gain in time, to provide that the resulting forward gain is higher than the requested gain in some periods of time and lower than the requested gain in other periods of time.

In an embodiment, the modulation of the requested forward gain provided by the feedback reduction unit exhibits a predetermined gain pattern over time with predefined and/or adaptively determined and adjusted gains $A_1$, $A_2$, $A_3$, . . . , $A_N$ in corresponding time periods $T_1$, $T_2$, $T_3$, . . . , $T_N$.

In an embodiment, the applied gain pattern comprises repeated occurrence of the predefined gain pattern $A_1$, $A_2$, $A_3$, . . . , $A_N$, wherein the repetition time (or cycle time) is $T_1+T_2+T_3+ \ldots +T_N$. In general, N is larger than or equal to two. In an embodiment, N is equal to 2 such as equal to 3.

In an embodiment, the first and second time periods are subdivided into a number of sub time periods $T_{H1}$, $T_{H2}$, . . . , $T_{HNH}$ and $T_{L1}$, $T_{L2}$, . . . , $T_{LNL}$, respectively, where NH and NL are the number of sub time periods of $T_N$ and $T_L$, respectively, and wherein each time period has its corresponding (possibly different) relatively high ($A_{H1}$, $A_{H2}$, . . . , $A_{HNH}$) and relatively low ($A_{L1}$, $A_{L2}$, . . . , $A_{LNL}$) gain, respectively. In an embodiment, the applied gain pattern comprises repeated occurrence of the predefined gain pattern ($A_{H1}$, $A_{H2}$, . . . , $A_{HNH}$, $A_{L1}$, $A_{L2}$, . . . , $A_{LNL}$), wherein the repetition time (or cycle time) is $T_{H1}+T_{H2}+ \ldots +T_{HNH}+T_{L1}+T_{L2}+ \ldots +T_{LNL}$.

In an embodiment, the predetermined (or dynamically determined) criterion comprises that the first $T_H$ and/or the second $T_L$ time period is determined in dependence of a, possibly averaged, roundtrip loop delay of the forward path and the external feedback path. In an embodiment, the first and second time periods are determined in dependence of the round trip loop delay (or an averaged round trip loop delay). In an embodiment, the modulation is periodic. In an embodiment, the first and second time periods succeed each other (a second time period follows a first time period, and a first time period follows a second time period). In an embodiment, the first and second time periods are repeated (with or without a pause between them). In an embodiment, the first and second time periods are repeated and follow immediately after one another (without a pause between them: $T_H$, $T_L$, $T_H$, $T_L$, . . . ). In an embodiment, the gain modulation is applied only in a specific feedback cancellation mode of operation. In an embodiment, there is a fading between the first and second time periods, e.g. as shown in FIG. 2B.

In an embodiment, the second time period $T_L$ is selected either similar to or smaller than the loop delay or an averaged round trip loop delay $T_{loop}$ or selected in relation to the loop delay by $T_{loop}/2<T_L<T_{loop}*2$. In an embodiment, the second time period $T_L$ is selected in relation to the loop delay or an averaged round trip loop delay by $T_{loop}/10<T_L<T_{loop}*10$. In an embodiment, the second time period $T_L$ is larger than or equal to the loop delay or an averaged round trip loop delay $T_{loop}$. In an embodiment, the first time period, $T_H$, is selected either (essentially) equal to the loop delay (or an averaged round trip loop delay), $T_{loop}$, or selected in relation to the loop delay by e.g. $T_{loop}/2<T_H<T_{loop}*2$ or $T_{loop}/10<T_H<T_{loop}*10$.

The loop delay may be different at different points in time, e.g. depending on the currently applied algorithms in the signal processing unit.

In an embodiment, the hearing device comprises a control unit for estimating a current loop or average loop delay or a deviation from a typical loop delay or a typical average loop delay. In an embodiment, the control unit is configured to measure a loop delay comprising a sum of a delay of the forward path and a delay of the feedback path. In an embodiment, a predefined test-signal (or a recognizable (preferably inaudible) modulation, e.g. dip or peak) is inserted in the forward path by the control unit and its round trip travel time measured (or estimated), e.g. by identification of the test signal (or modulation) when it arrives in the forward path after a single (or a number of) propagation of the loop. In an embodiment, a typical loop delay is of the order of ms, e.g. around 10 ms. Typically the acoustic part of the loop delay is much less than the electric (processing) part of the loop delay. In an embodiment the electric (processing) part of the loop delay is in the range between 2 ms and 10 ms, e.g. in the range between 5 ins and 8 ms, e.g. around 7 ms. The loop delay may be relatively constant over time (and e.g. determined in advance of operation of the hearing device) or be different at different points in time, e.g. depending on the currently applied algorithms in the signal processing unit (e.g. dynamically determined (estimated) during use). The hearing device (HD) may e.g. comprise a memory unit wherein typical loop delays in different modes of operation of the hearing device are stored.

In an embodiment, the predetermined or adaptively determined criterion comprises that the first and second time periods and the first and second gains are configured to conserve energy in the resulting signal compared to the signal before said modulation of the requested forward gain. In an embodiment, the first and second time periods and the first and second gains are configured to conserve energy in the resulting signal compared to the signal before said modulation of said requested forward gain. In an embodiment, the applied gain pattern comprising repeated occurrences of the predefined gain pattern $A_1$, $A_2$, $A_3$, . . . , $A_N$ (wherein the repetition time (or cycle time) is $T_1$ $T_2+T_3+ \ldots +T_N$), is configured to conserve energy in the resulting signal compared to the signal before the modulation of the requested forward gain. This has the advantage of preventing feedback problems without changing the signal energy. In an embodiment, the first and second time periods $T_H$, $T_L$, and the reduced gain $A_L$ are determined first and the increased gain $A_H$ is subsequently determined to conserve energy in the resulting signal (compared to a situation without application of the increased and reduced gains according to the present disclosure). In an embodiment, the first, increased gain $A_H$ is determined from the second, reduced gain $A_L$, the first and second time periods $T_H$, and $T_L$. In an embodiment, $A_H=f(A_L, T_H, T_L.)$ under the constraint that energy is conserved in the resulting signal (compared to the signal before the gain modification). In an embodiment, the first, increased gain $A_H$ is equal to SQRT (2), and the second, reduced gain $A_L$ is equal to 0. In an embodiment, the first and second time periods $T_H$ and $T_L$, respectively, are substantially equal. In an embodiment, $A_L$ is a function of $A_H$, $T_H$, and $T_L$ (i.e. $A_L=f(A_H, T_H, T_L)$). In an embodiment, $T_H=f(A_L, A_H, T_L)$. In an embodiment, $T_L=f(A_L, A_H, T_H)$. In an embodiment, the relations are fulfilled under the further constraint that energy is conserved in the resulting signal.

In an embodiment, the predetermined or adaptively determined criterion comprises that the first time period $T_H$ and the second time period $T_L$ are chosen randomly, whereas the first, increased gain $A_H$ and the second, reduced gain $A_L$ are chosen to conserve the output signal energy.

In an embodiment, the predetermined or adaptively determined criterion comprises that the first time period $T_H$ and the second time period $T_L$ are chosen randomly, but in relation to the loop delay (or average loop delay) $T_{loop}$, e.g. such that $T_H+T_L=2*T_{loop}$, whereas the increased gain $A_H$ and the reduced gain $A_L$ are chosen to conserve the output signal energy.

In an embodiment, the hearing device is configured to provide that the increased gain $A_H$ and/or the reduced gain $A_L$ is/are variable during said first and second time periods $T_H$, and $T_L$. In an embodiment, the hearing device is configured to provide that the increased gain $A_H$ is (e.g. monotonously) increasing from a minimum value (e.g. $A_{H0}$) towards a maximum value (e.g. $A_{H1}$) (e.g. in a first half-period of the first time period $T_H$) and then (e.g. monotonously) decreasing towards the minimum value (e.g. during a second half-period of the first time period $T_H$). In an embodiment, the hearing device is configured to provide that the reduced gain $A_L$ is (e.g. monotonously) decreasing from a maximum value (e.g. $A_{L1}$) towards a minimum value (e.g. $A_{L0}$) (e.g. in a first half-period of the second time period $T_L$) and then (e.g. monotonously) increasing towards the maximum value (e.g. during a second half-period of the second time period $T_L$). In an embodiment, the maximum value ($A_{L1}$) of the reduced gain $A_L$ is (substantially) equal to the minimum value ($A_{H0}$) of the increased gain $A_H$. (cf. e.g. FIG. 2B). In an embodiment, the hearing device is configured to provide that the increased gain $A_H$ and/or the reduced gain $A_L$ is/are (essentially) constant during said first and second time periods $T_H$ and $T_L$, respectively.

In an embodiment, the hearing device comprises a time to time-frequency conversion unit for providing the electric input signal or a signal derived therefrom in a number of frequency bands. In an embodiment, the time to time-frequency conversion unit comprises an analysis filter bank or a Fourier transformation unit (e.g. based on a Fast Fourier transformation algorithm). In an embodiment, the hearing device comprises time-frequency to time conversion unit for providing an electric output signal as a time domain signal (e.g a synthesis filter bank or an inverse Fast Fourier transformation algorithm).

In an embodiment, the hearing device is configured to provide that the gain modification over time is performed in one or more selected or all frequency bands. In an embodiment, each selected band may exhibit individual gain modulation characteristics (e.g. individual (band specific) $A_H$, $A_L$, $T_H$, $T_L$). These four (or more, e.g. $A_3$, $A_4$, . . . , $T_3$, $T_4$, . . . ) parameters for each band can be set up independent of other bands. Also, the gain modulation algorithm, does not have to be enabled at all times, but can be enabled/disabled in each frequency band separately, e.g. online, e.g. based on one or more detectors for monitoring a current input signal of the hearing device and/or on the current acoustic environment (e.g. including a feedback detector).

In an embodiment, the hearing device is adapted to provide that the increased gain $A_H$ and/or the reduced gain $A_L$ is/are configurable for at least some of the frequency bands. In an embodiment, the increased gain $A_H$ and/or the reduced gain $A_L$ can be individually set for at least some of the frequency bands $FB_i$, i=1, 2, . . . , $N_{FB}$. In an embodiment, the increased gain $A_H$ and/or the reduced gain $A_L$ are set to the same values $A_{H,0}$ and $A_{L,0}$, respectively, in at least some of the frequency bands. In an embodiment, each of $A_H(FB_i)$, $A_L(FB_i)$, $T_H(FB_i)$, $T_L(FB_i)$ and a time offset $T_d(FB_i)$ between a gain pattern of a neighbouring frequency band can be chosen independent of each other.

In an embodiment, the hearing device is adapted to provide that said increased gain $A_H$ said reduced gain $A_L$ are only applied in frequency bands expected to be at risk of howl. In an embodiment, hearing device is adapted to provide that said increased gain $A_H$ said reduced gain $A_L$ are only applied in frequency bands expected to be at risk of howl. The frequency band or bands expected to be at risk of howl may e.g. be estimated or determined in advance of normal operation of the hearing device, e.g. at a fitting session, where the hearing device is adapted to a particular users needs (e.g. the a hearing e.g. to compensate for a hearing impairment of the user). Alternatively or additionally, frequency band or bands expected to be at risk of howl may e.g. be selected automatically online, e.g. determined by a feedback detector for estimating a current level of feedback in a given frequency band.

In an embodiment, the hearing device is adapted to provide that said increased gain $A_H$ said reduced gain $A_L$ are only applied in frequency bands above a first threshold frequency, $f_{THL}$ (cf. e.g. FIG. 3A). In an embodiment, the first threshold frequency, $f_{THL}$ is smaller than or equal to 1 kHz. In an embodiment, the first threshold frequency, $f_{THL}$ in is a range between 500 Hz and 1 kHz. In an embodiment, the first threshold frequency, $f_{THL}$ is smaller than or equal to 2 kHz. In an embodiment, the first threshold frequency, $f_{THL}$ is in a range between 1 kHz and 2 kHz. In an embodiment, the hearing device is adapted to provide that the increased gain $A_H$ and the reduced gain $A_L$ are only applied in frequency bands above a first threshold frequency, $f_{THL}$ and below a second threshold frequency, $f_{THH}$. In an embodiment, the second threshold frequency, $f_{THH}$ is larger than or equal to 5 kHz. In an embodiment, the second threshold frequency, $f_{THL}$ is in a range between 5 kHz and 10 kHz.

In an embodiment, the hearing device comprises a hearing aid, a headset, an active ear protection system or a combination thereof.

The signal processing unit is configured for enhancing the input signals and providing a processed output signal. In an embodiment, the hearing device (e.g. the signal processing unit) is adapted to provide a frequency dependent gain and/or a level dependent compression and/or a transposition (with or without frequency compression) of one or more frequency ranges to one or more other frequency ranges, e.g. to compensate for a hearing impairment of a user. Various aspects of digital hearing aids are described in [Schaub; 2008].

The hearing device comprises an output transducer adapted for providing a stimulus perceived by the user as an acoustic signal based on a processed electric signal. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

The hearing device comprises an input transducer for providing an electric input signal representing sound. In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the hearing device comprises antenna and transceiver circuitry for wirelessly receiving a direct electric input signal from another device, e.g. a communication device or another hearing device.

In an embodiment, the hearing device is (or comprises) a portable device, e.g. a device comprising a local energy source, e.g. a battery, e.g. a rechargeable battery.

The hearing device comprises a forward or signal path between an input transducer (microphone system and/or direct electric input (e.g. a wireless receiver)) and an output transducer. The signal processing unit is located in the forward path. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, the hearing device comprises a voice detector (VD) for determining whether or not an input signal comprises a voice signal (at a given point in feedback reduction unit time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device comprises an acoustic (and/or mechanical) feedback suppression system (in addition to the feedback reduction unit).

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of operating a hearing device comprising a forward path for applying a resulting forward gain to the electric input signal and providing a resulting signal is provided. The method comprises providing the electric input signal representing sound;

applying a requested forward gain to the electric input signal or a signal originating therefrom and providing a processed signal; and providing a resulting signal for conversion to an output sound is furthermore provided by the present application.

The method further comprises reducing a risk of howl due to acoustic or mechanical feedback of an external feedback path leaking the output sound to the input sound by modulating said requested forward gain in time, to provide that the resulting forward gain exhibits a first, increased gain $A_H$ in a first time period $T_H$ and a second, reduced gain $A_L$ in a second time period $T_L$, and providing that at least one of the first gain $A_H$, the second gain $A_L$, the first time period $T_H$, and the second time period $T_L$ is/are determined according to a predetermined or adaptively determined criterion.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, the method comprises providing that the first and/or the second time period is larger than or equal to the loop delay.

In an embodiment, the method comprises providing that the first and second time periods and the first and second gains are configured to conserve energy in the resulting signal compared to the signal before said modulation of said requested forward gain.

In an embodiment, the method comprises providing that at least one (such as at least two, or all) of said first, increased gain $A_H$, said first time period $T_H$, said second, reduced gain $A_L$, and said second time period $T_L$, is/are selected using a model of human auditory perception in order to make said modulation of the requested forward gain less audible or even inaudible to the user. In an embodiment, the model of human auditory perception comprises a psychoacoustic model. In an embodiment, at least one of said first, increased gain $A_H$, said first time period $T_H$, said second, reduced gain $A_L$, and said second time period $T_L$ is/are selected based on knowledge of one or more of a user's hearing loss, auditory bandwidth, spectro/temporal masking effect and/or modulation sensitivity, in order to make the sound processing less audible or even inaudible to the user.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium. The proposed method may be implemented/stored in RAM, ROM, EEPROM or other computer readable media of the hearing device.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s) (e.g. for entering or leaving a specific feedback cancellation mode of operation according to the present disclosure). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme). In an embodiment, the auxiliary device is or comprises a cellular telephone, e.g. a smartphone. In an embodiment, the auxiliary device is or comprises a wireless microphone, e.g. a partner microphone, for transmitting a voice of a communication partner to the user of the hearing device. In an embodiment, the auxiliary device is or comprises a transmission device for transmitting sound of a TV-set or another entertainment device to the hearing device (either directly or via an intermediate device, e.g. an audio gateway device).

In an embodiment, the auxiliary device is another hearing device. In an embodiment, the hearing system comprises two hearing devices adapted to implement a binaural hearing system, e.g. a binaural hearing aid system.

Definitions

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

FIG. 1 shows embodiments of a hearing device comprising a feedback reduction system.

Figure 1A:
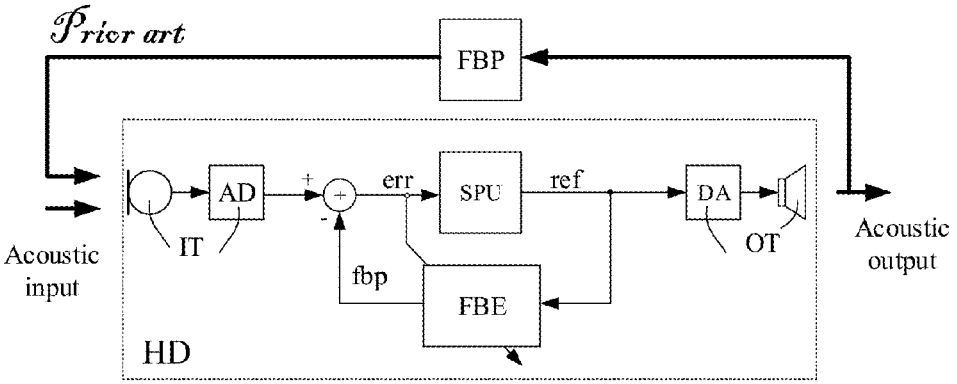
FIGS. 1A-1D shows embodiments of a hearing device comprising a feedback reduction system, FIGS. 1A and 1B illustrating prior art configurations where an electric feedback compensation path is established for subtracting an estimate of the external feedback path from the input signal, FIG. 1C illustrating an embodiment according to the present disclosure comprising a feedback reduction unit in the forward path, and FIG. 1D illustrating an embodiment according to the present disclosure comprising a feedback reduction unit in the forward path as well as a conventional feedback cancellation system based on an adaptive filter.
Figure 1B:
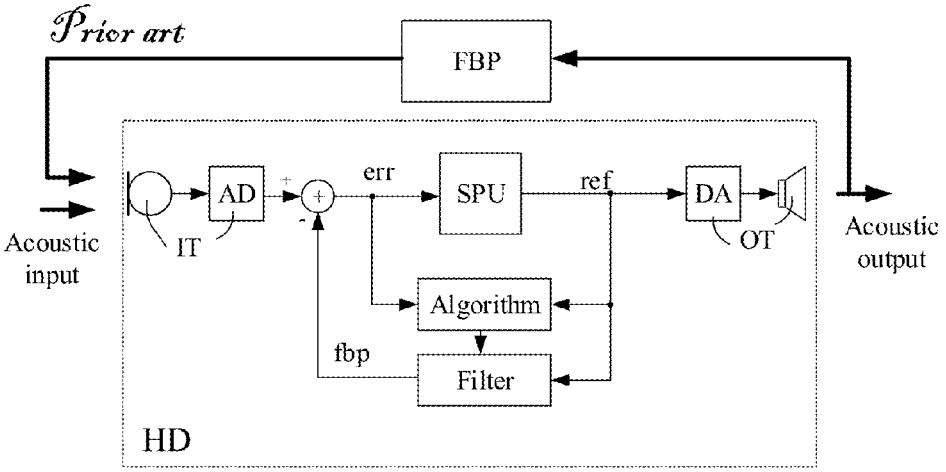

FIGS. 1A and 1B illustrates prior art configurations where an electric feedback compensation path is established for subtracting an estimate of the external feedback path from the input signal. FIGS. 1A and 1B schematically shows exemplary basic functions of a prior art hearing device (HD) (denoted Prior Art) comprising a forward or signal path from an input transducer (IT) to an output transducer (OT). In the embodiments of FIGS. 1A and 1B, the input transducer (IT) comprises a microphone for converting an input sound (Acoustic input in FIG. 1) to an analogue electric input signal and an analogue-to-digital (AD) converter to digitize the analogue electric input signal from the microphone with a predefined sampling rate, e.g. 20 kHz, and provide a digitized electric input signal to the forward path. In the embodiments of FIGS. 1A and 1B, the output transducer (OT) comprises a digital-to-analogue (DA) converter to convert a digital signal to an analogue electric output signal and a loudspeaker presenting the analogue electric output signal to a user as an output sound (Acoustic output). The forward path comprises a signal processing unit (SPU) for applying a level and/or frequency dependent gain to the signal from the input transducer (or a signal derived therefrom) and providing an enhanced signal to the output transducer. An 'external' or 'acoustic' feedback path (FBP) from output to input transducer of the hearing device is indicated. The external feedback path leaks a part of the output sound from the output transducer (Acoustic output) to the input transducer (as indicated by the bold arrow from the output transducer to the input transducer. The input sound (Acoustic input) presented at the input transducer (IT) comprises this leaked 'feedback signal' in combination with any sound from the environment (as indicated by the bold arrow beneath the acoustic feedback path). The hearing device (HD) further comprises an anti-feedback system comprising a feedback estimation unit (FBE) for estimating the acoustic feedback path (FPB) from the output transducer to the input transducer and providing a signal fbp representative thereof. The anti-feedback system further comprises a summation (subtraction) unit ('+') for subtracting the signal fbp representative of the current acoustic feedback path from the (digitized) electric input signal and providing a feedback corrected signal (error signal err), which is fed to the signal processing unit (SPU), and to the feedback estimation unit (FBE). The hearing device (HD) further comprises a battery (not shown) for providing current to the functional blocks of the hearing device and possible other functional blocks. The processing of the hearing device may be performed fully or partially in the time domain.

FIG. 1B shows an embodiment of a hearing device (HD) as shown in FIG. 1A, but the feedback estimation units (FBE) comprises an adaptive filter, which is controlled by an estimation algorithm (Algorithm), e.g. an LMS (Least Means Squared) algorithm, in order to predict and cancel the part of the input transducer (here microphone) signal that is caused by feedback. The adaptive filter in FIG. 1B comprises a variable filter part (Filter) and an adaptive estimation algorithm part (Algorithm). The feedback estimation unit (adaptive filter Algorithm, Filter) is (here) aimed at providing a good estimate of the 'external' feedback path from the output transducer (OT) to the input transducer (IT). The estimation algorithm (of the Algorithm unit) uses a reference signal (ref) together with a signal of the forward path originating from the microphone signal (here feedback corrected signal err from the combination unit (+)) to find the setting (filter coefficients) of the adaptive filter (when applied to the Filter) that minimizes the estimation error when the reference signal (ref) is applied to the adaptive filter (input to Filter part). In the embodiment of FIG. 1B, the calculation of filter coefficients in the Algorithm part of the adaptive filter is performed in the time domain based on signals err and ref and transferred to the variable filter part (Filter). The variable filter part is configured to filter, time domain signal ref and provide acoustic feedback path estimate signal fbp in the time domain. Alternatively, the update and variable filter parts (Algorithm, Filter) may work in the frequency and/or subband domain.

To provide an improved de-correlation between the output and input signal, it may be desirable to add a probe signal to the output signal. This probe signal can be used as the reference signal to the algorithm part of the adaptive filter, and/or it may be mixed with the ordinary output of the hearing aid to form the reference signal. Alternatively, a (small) frequency or phase shift may be introduced in a signal of the forward path.

Figure 1C:
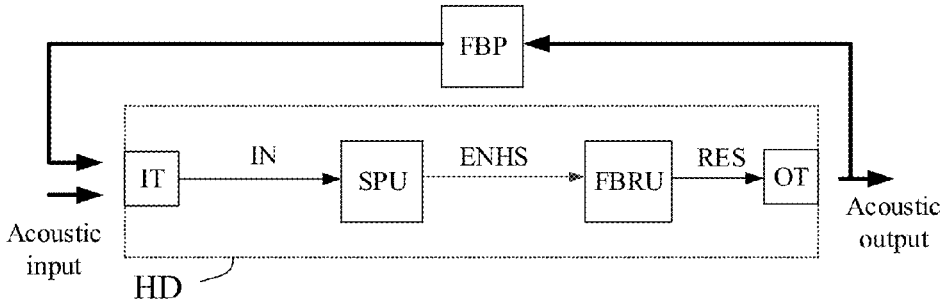

FIG. 1C illustrates an embodiment of a hearing device (HD) according to the present disclosure comprising a feedback reduction unit (FBRU) in the forward path of the hearing device. The forward path of the embodiment of a hearing device (HD) shown in FIG. 1C comprises the same functional unis shown in an as described in connection with FIGS. 1A and 1B, but instead of (or in addition to) the anti-feedback system, the hearing device of FIG. 1C comprises a feedback reduction unit (FBRU) in the forward path. The feedback reduction unit (FBRU) is in the embodiment of FIG. 1C located between the signal processing unit (SPU) and the output transducer (OT). The feedback reduction unit (FBRU) may alternatively be located elsewhere in the forward path, e.g. between the input transducer (IT) and the signal processing unit (SPU), or it may form part of the signal processing unit (SPU). The input transducer (IT) provides a digitized electric input signal IN representative of the Acoustic input. This signal is fed to the signal processing unit (SPU) providing an enhanced signal ENHS (after application of a requested (e.g. frequency and/or level dependent) gain to the electric input signal IN). The enhanced signal ENHS is fed to the feedback reduction unit (FBRU) providing a resulting signal RES, which is fed to the output transducer (OT) for conversion to an Acoustic output. The feedback reduction unit (FBRU) is configured to modulate the requested forward gain in time. Preferably, the requested forward gain applied to the signal processing unit (SPU) is modulated to provide that the resulting forward gain exhibits a first, increased gain $A_L$ in a first time period $T_H$ and a second, reduced gain $A_L$ in a second time period $T_L$, (cf. e.g. FIG. 2, 3) wherein the first and second time periods $T_H$, $T_L$ are determined in dependence of the roundtrip loop delay $T_{loop}$ (cf. FIG. 5A). In an embodiment, the signal processing unit (SPU) and the feedback reduction unit (FBRU) are integrated so that a resulting (modified) gain can be applied to the electric input signal in a single operation (cf. e.g. FIG. 4A), e.g. in each of a number of frequency bands.

Figure 1D:
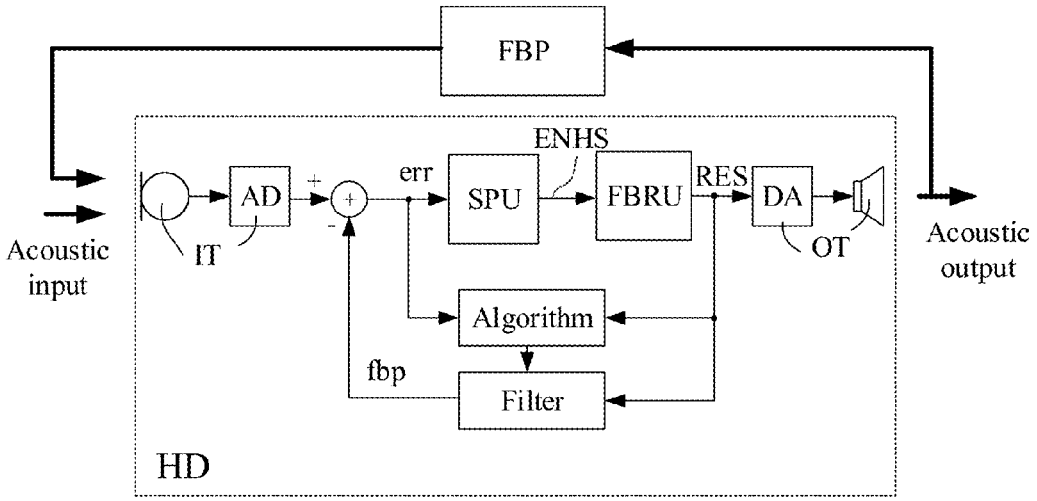

FIG. 1D shows an embodiment of a hearing device (HD) according to the present disclosure comprising a feedback reduction unit (FBRU) in the forward path of the hearing device as shown in FIG. 1C as well as an anti-feedback system comprising a feedback estimation unit (FBE) for estimating the acoustic feedback path (FPB) from the output transducer to the input transducer and a subtraction unit ('+'), as shown in FIGS. 1A and 1B. The (reference) input signal (RES) to the adaptive filter (Algorithm and Filter units) is preferably taken after the feedback reduction unit (FBRU) (e.g. the output of FBRU). The feedback reduction unit (FBRU) is preferably (and as shown in FIG. 1D) located after the signal processing unit (SPU), but it may in principle be located anywhere between the signals err and RES in the forward path (e.g. before or integrated with the SPU-unit). In such case, the processing performed in the signal processing unit (SPU) should be appropriately adapted, though.

The signal processing unit (SPU in FIG. 1) is e.g. adapted to adjust the electric input signal to an impaired hearing of the user (the hearing device described in FIG. 1 may thus constitute or comprise a hearing aid).

Figure 2A:
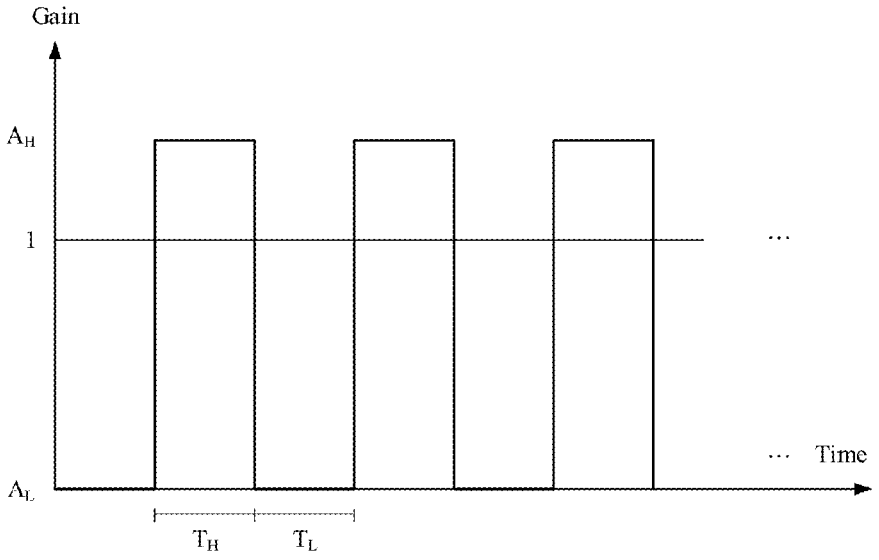
FIGS. 2A-2C shows two examples of a repetitive time dependent gain pattern to be applied to a signal of the forward path of an embodiment of a hearing device according to the present disclosure, FIG. 2A illustrating rectangular pulse shaped pattern, FIG. 2B illustrating a softly smoothed pulse pattern, and FIG. 2C illustrating a rectangular pulse shaped pattern where the first and second time periods, $T_H$ and $T_L$, respectively, are different.
Figure 2B:
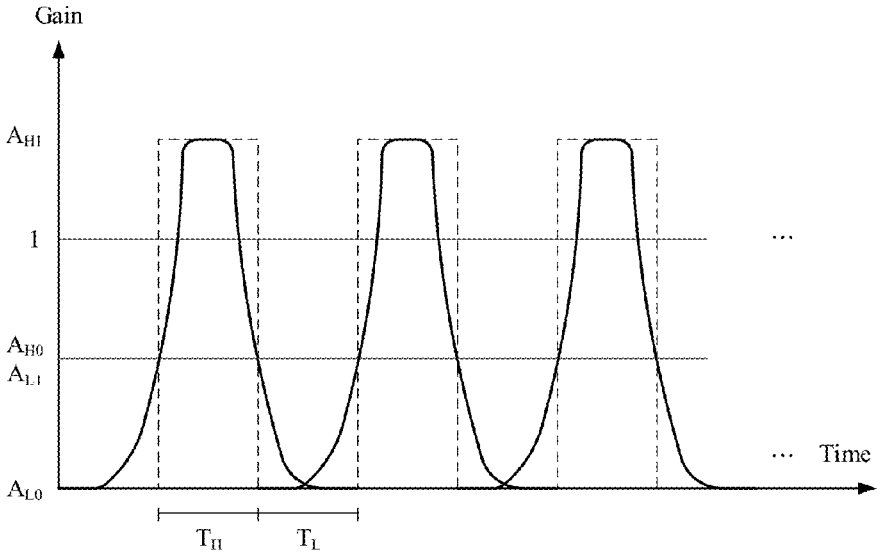
Figure 2C:
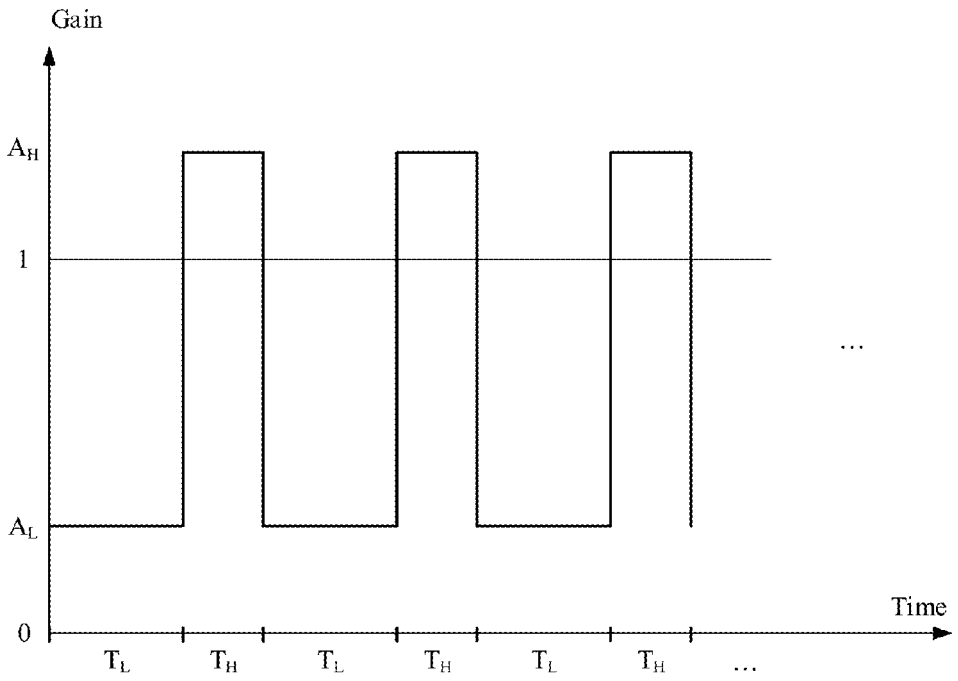

FIG. 2 shows three examples (FIG. 2A, 2B, 2C) of a repetitive time (Time) dependent gain (Gain) pattern to be applied to a signal of the forward path (cf. feedback reduction unit FBRU of FIG. 1C, 1D, 4B, 4C, 5B), of an embodiment of a hearing device according to the present disclosure.

A basic concept of the feedback reduction scheme according to the present disclosure to prevent howling is to break the feedback loop by varying the forward path gain over time.

FIG. 2A schematically illustrates an exemplary rectangular pulse shaped pattern for this purpose. The gain modification proposed by the present disclosure is indicated relative to the otherwise 'requested gain' (i.e. the gain that would otherwise be applied to the electric input signal to present an enhanced signal to the user, e.g. to compensate for a hearing impairment). Without the gain modification introduced by the present disclosure, it corresponds to a unity gain of 1 (thin solid line). The simple gain modification shown in FIG. 2A (bold solid line) consists of repeated periods of high gain $A_H$ and low gain $A_L$ periods with durations $T_H$ and $T_L$. In an embodiment, $A_H$ is around 1.4 and $A_L$ is around 0. The durations of $T_H$ and $T_L$ are in a similar order of magnitude as (e.g. approximately equal to) the loop delay in the acoustic feedback system. $T_H$ and $T_L$ can be adjusted to obtain different performance. In an embodiment, both time periods are close to the loop delay $T_{loop}$. As an example, when the loop delay $T_{loop}$=10 ms, the duration of $T_L$ can be chosen to be $T_L$=5 ms, 9 ms, 10 ms, 11 ms, . . . or 30 ms etc, and the duration of $T_H$ can be chosen to be $T_H$=30 ms, 11 ms, 10 ms, 9 ms, 5 ms etc. Hence, for the feedback signal that travels around the loop, either $A_H$ or $A_L$ is applied each time. The resulting gain function over time would be $A_H*A_L*A_H*A_L$ . . . , depending on the T values chosen. In the case of $A_L$=0, we remove the feedback signal and this prevents a howl to build up.

The value of $A_L$ can be adjusted, but it should be close to 0 for maximum performance. If desirable, the value of $A_B$ should be adjusted according to $A_L$, so that the total signal energy does not change by the applied gain pattern (assuming that the signal is stationary with one period of $T_H$+$T_L$). This can be done by computing $$A_H = \sqrt{\frac{T_L + T_H}{T_H} - A_L^2 \frac{T_L}{T_H}}$$

The example broadband gain pattern shown in FIG. 2A illustrates the principle of this disclosure, but it may introduce sound quality degradation. In practice, to avoid or minimize such degradation, a more advanced gain pattern over time and frequency may be used (such as the one shown in FIG. 3).

It should be noted, that the transition between the two amplitudes $A_H$ and $A_L$ (as shown in FIG. 2A) does not necessarily happen immediately but can also be a smooth transition from e.g. $A_H$ to $A_L$ and vice versa. This is exemplified in FIG. 2B. The gain is smoothly changed from its low value ($A_L$) to its high value ($A_H$) (instead of abruptly as in FIG. 2A). The abrupt gain modulation pattern of FIG. 2A is indicated in FIG. 2B in dashed line. In FIG. 2B, the individual gains (here the increased gain $A_H$ and the reduced gain $A_L$) is variable during the respective first and second time periods $T_H$ and $T_L$. In the example of FIG. 2B, the increased gain $A_H$ is monotonously increasing from a minimum value ($A_{H0}$) towards a maximum value ($A_{H1}$) (here in a first half-period of the first time period $T_H$) and then monotonously decreasing towards the minimum value (here during a second half-period of the first time period $T_H$).

Correspondingly, the reduced gain $A_L$ is monotonously decreasing from a maximum value ($A_{L1}$) towards a minimum value ($A_{L0}$) (here in a first half-period of the second time period $T_L$) and then monotonously increasing towards the maximum value (here during a second half-period of the second time period $T_L$). Preferably, as shown in the example of FIG. 2B, the maximum value ($A_{L1}$) of the reduced gain $A_L$ is (substantially) equal to the minimum value ($A_{H0}$) of the increased gain $A_H$.

The first and second time periods, $T_H$ and $T_L$, respectively, are indicated to be equal in FIGS. 2A and 2B ($T_H$=$T_L$). This need not be the case, however, as illustrated in FIG. 2C, where the second time period $T_L$ is larger than the first time period $T_H$. The gain pattern of FIG. 2C is shown as a rectangular pattern, but may alternatively take any other appropriate form, e.g. involving a smooth transition from low ($A_L$) to high ($A_H$) gain and/or from high ($A_H$) to low ($A_L$) gain.

Figure 5A:
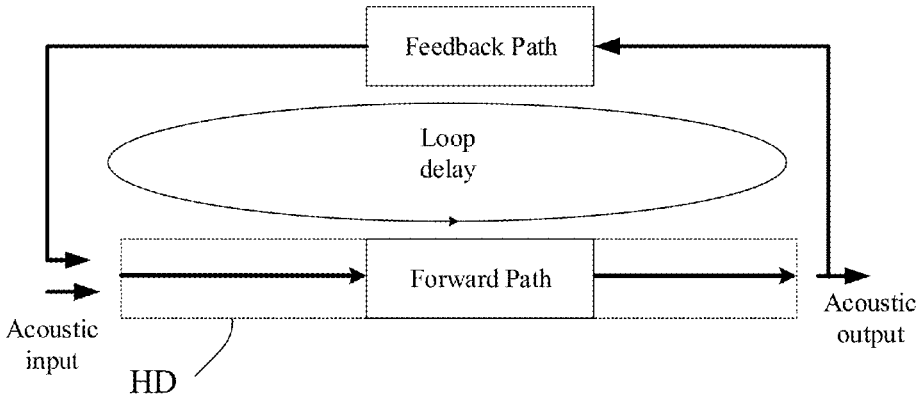
FIG. 5 shows in FIG. 5A a forward path and a feedback path of a hearing device and a corresponding loop delay comprising a sum of the propagation delays of the forward and feedback paths, and in FIG. 5B an embodiment of a hearing device according to the present disclosure comprising a loop delay estimation unit and a user interface.

In an embodiment, the first and second time periods ($T_H$ and $T_L$, respectively) are determined in dependence of the round trip loop delay (cf. e.g. FIG. 5A). Preferably, the first and second time periods ($T_H$ and $T_L$, respectively) and the first and second gains ($A_H$ and $A_L$, respectively) are configured to conserve energy in the resulting signal compared to the signal before the modulation of the forward gain.

Figure 3A:
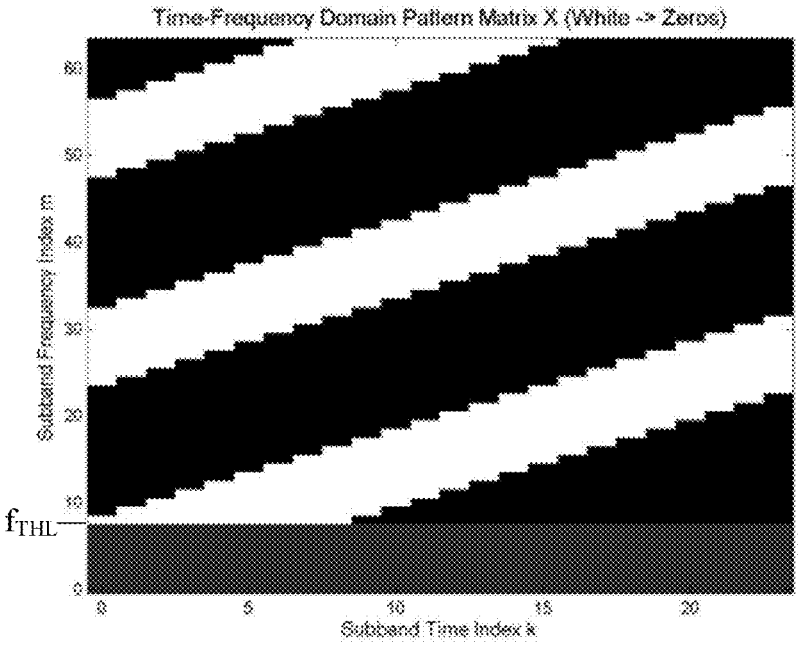
FIG. 3 shows in FIG. 3A a repetitive gain pattern in a time-frequency representation, where the lowest eight frequency bands apply a gain of unity.
FIG. 3B illustrates parameters of the repetitive gain pattern (characteristic gains and time periods) of three adjacent frequency bands with frequency band index i−1, i, i+1, where $8<i<65$.
Figure 3B:
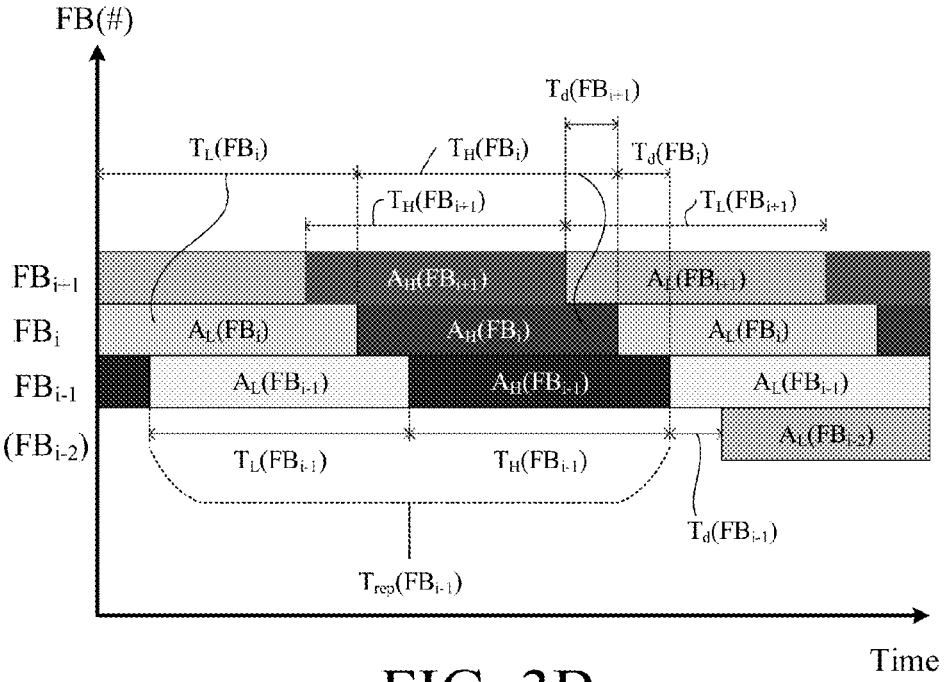

This algorithm can, in a system with frequency subbands (cf. FIG. 3), be applied in each subband separately with different (first and second gains) $A_{H_subband_i}$ and $A_{L_subband_i}$ and different (first and second time periods) $T_{H_subband_i}$ and $T_{L_subband_i}$ and an initial time shift as implied by $T_{d_subband_i}$ as indicated in FIG. 3B (as $A_H(FB_i)$, $A_L(FB_i)$, $T_H(FB_i)$, $T_L(FB_i)$, and $T_d(FB_i)$, respectively, for the $i^{th}$ frequency band $FB_i$). Also, the algorithm, does not have to be enabled at all time and/or in all subbands, but can be disabled in some frequency subbands while enabled/disabled in some other subbands separately online, e.g. based on the output of feedback detectors (e.g. indicating a probability of feedback being currently present in a given frequency band). In an embodiment, the algorithm is enabled in a specific feedback reduction mode. In an embodiment, the algorithm is disabled in other modes of operation of the hearing device.

FIG. 3 shows in FIG. 3A a repetitive gain pattern in a time-frequency representation, where the lowest eight frequency bands apply a gain of unity, and FIG. 3B illustrates parameters of the repetitive gain pattern (characteristic gains and time periods) of three adjacent frequency bands with frequency band index i−1, i, i+1, where 8<i<65.

FIG. 3A shows an exemplary time-frequency representation of a gain modulation according to the present disclosure. The horizontal axis represents time (Subband Time Index k), including a time range between time indices 0 and approximately 24, a single time unit representing 1 ms. The vertical axis represents frequency (Subband Frequency Index m), including a frequency range between frequency indices 0 and approximately 63.

According to the scheme of FIG. 3A, we apply a specific gain in each time-frequency unit, and we apply a unity gain (indicated in grey shading) in the lowest frequency bands (below a first threshold frequency $f_{THL}$), e.g. frequency bands $FB_i$, where i<9, to preserve good sound quality. In an embodiment, the first threshold frequency $f_{THL}$ is ≤2 kHz, such as ≤2 kHz.

The time-frequency units displayed in white colour indicate amplitude (gain) $A_L$=0, whereas the time-frequency units displayed in black colour indicate gain $A_H$. The pattern in FIG. 3A is assumed to be repeated over time.

An advantage of the gain pattern of FIG. 3A is that (as opposed to a gain pattern of FIG. 2 when applied to a time-domain signal) at any given point in time contains components of the enhanced signal representing a target signal. The gain pattern of FIG. 3A ensures that the target signal is always present at least in some of the frequency bands (e.g. in at least half of the frequency bands).

The duration of a time step could e.g. be 5 ms, 10 ms, 20 ms etc. depending on the loop delay $T_{loop}$. The frequency bands can be uniformly distributed over the entire frequency spectrum as shown in FIG. 3A, or it can be divided non-uniformly. The bandwidth could e.g. be 50 Hz, 100 Hz, 500 Hz, 1000 Hz, 2000 Hz, and 5000 Hz etc.

FIG. 3B schematically shows the characteristic first and second time periods $T_H$ and $T_L$ and the corresponding first and second gains $A_H$ and $A_L$ associated therewith for three neighbouring frequency bands $FB_x$ with frequency indices i−1, i and in i+1, respectively. Each of the parameters $A_H(FB_x)$, $T_H(FB_x)$, $A_L(FB_x)$, $T_L(FB_x)$ and $T_d(FB_x)$, x=i−1, i, i+1 may be individually determined. In an embodiment, the first gains $A_H(FB_x)$ are equal for at least some of the frequency bands. In an embodiment, the second gains $A_L(FB_x)$ are equal for at least some of the frequency bands. In an embodiment, the first time periods $T_H(FB_x)$ are equal for at least some of the frequency bands. In an embodiment, the second time periods $T_L(FB_x)$ are equal for at least some of the frequency bands. In an embodiment, the delay parameters $T_d(FB_x)$ are equal for at least some of the frequency bands. In an embodiment, the gain patterns of at least some of the frequency bands $FB_x$ are defined by the parameters $A_H(FB_x)$, $T_H(FB_x)$, $A_L(FB_x)$, $T_L(FB_x)$, and $T_d(FB_x)$. In an embodiment, the gain patterns of at least some of the frequency bands $FB_x$ each comprise a repetitive, alternating occurrence of a first gain $A_H(FB_x)$ in a first time period $T_H(FB_x)$, and a second gain $A_L(FB_x)$ in a second time period $T_L(FB_x)$. In an embodiment, the gain patterns of at least some of the frequency bands $FB_x$ are equal for at least some of the frequency bands $FB_x$ apart from a start time of the individual gain patterns. In an embodiment, the start time of the gain patterns (e.g. defined by the start of a time period with a low gain $A_L$) of at least some of the frequency bands $FB_x$ are shifted relative to each other. In an embodiment, the start time of the gain patterns of at least some of the frequency bands $FB_x$ are shifted relative to each other so that gain patterns of neighbouring frequency bands $FB_{i-1}$, $FB_i$ are shifted $T_d(FB_i)$ (or $T_d$ if independent of frequency band) relative to each other (e.g. the gain pattern of frequency band $FB_i$ is shifted −Td($FB_i$) relative to frequency band $FB_{i-1}$ in the example shown in FIG. 3B). A repetition time $T_{rep}$ of the gain pattern of frequency bands $FB_x$ in FIG. 3 is defined as a sum of the first and second time periods $T_H$ and $T_L$ for the band in question. This is indicated in FIG. 3B for frequency band $FB_{i-1}$: $T_{rep}(FB_{i-1})=T_H(FB_{i-1})+T_L(FB_{i-1})$.

Using the frequency independent gain pattern in FIG. 2, the output signal would be on and off, whereas the frequency dependent pattern in FIG. 3A allows the output signal to be continuous, at least for signals with multiple frequency components such as speech and most music signals.

As an example, when the loop delay $T_{loop}$ equals 10 ms, the duration of $T_L(FB_i)$ can be chosen to be $T_L(FB_i)$=(9 ms), 10 ms, 11 ms, . . . , or 20 ms etc., the duration of $T_H(FB_i)$ can be chosen to be $T_H(FB_i)$=(11 ms), 10 ms, 9 ms, . . . 5 ms etc., the duration of the shift in time between gain patterns of adjacent frequency bands $T_d(FB_i)\leq T_{rep}(FB_i)=T_H(FB_i)+T_L(FB_i)$ can be $T_d(FB_i)$=0.01 ms, 0.05 ms, 0.1 ms, 0.2 ms, 0.5 ms, 1 ms, etc.

Figure 4A:
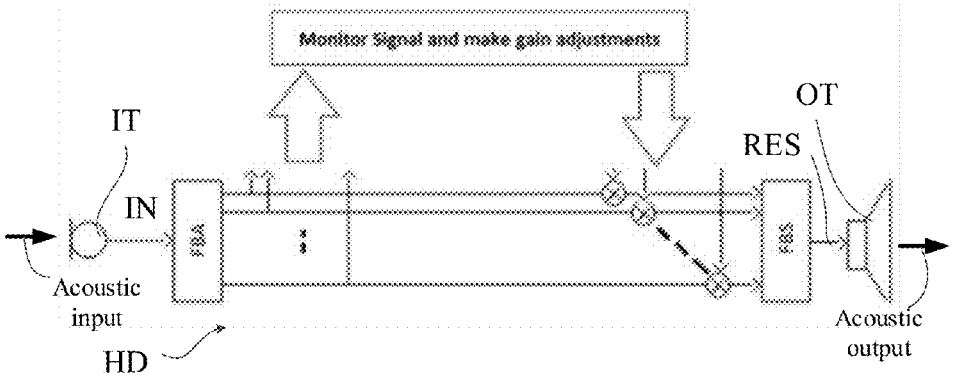
FIGS. 4A-4C shows three exemplary embodiments of a hearing device according to the present disclosure, all comprising a forward path mainly operated in the time-frequency domain, FIG. 4A and FIG. 4B illustrating embodiments comprising input and output transducers, analysis and synthesis filter banks and one or more gain adjustment blocks there between, FIG. 4C showing an embodiment combining a conventional feedback cancellation system with a feedback reduction unit as described in the present disclosure.
Figure 4B:
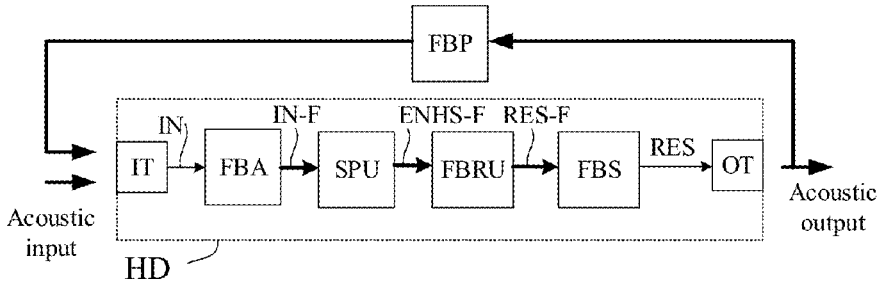
Figure 4C:
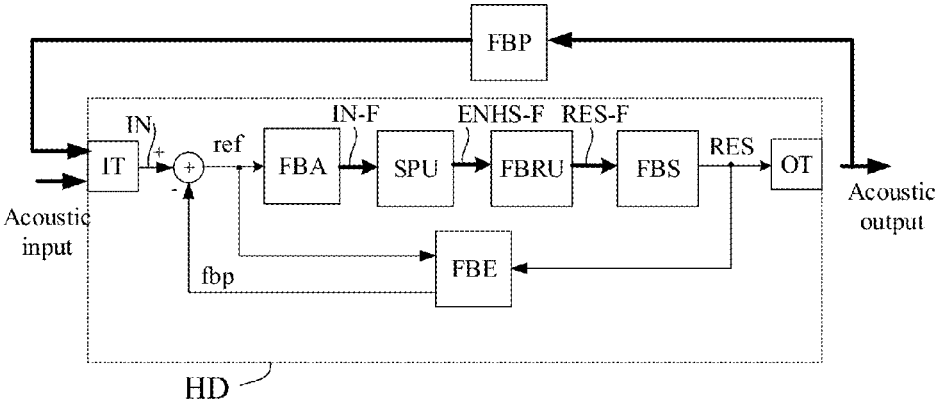

FIG. 4 shows three exemplary embodiments of a hearing device (HD) according to the present disclosure, all comprising a forward path mainly operated in the time-frequency domain. FIGS. 4A, 4B and 4C illustrate respective embodiments each comprising input and output transducers, analysis and synthesis filter banks and one or more gain adjustment blocks there between.

All three embodiments of a hearing device (HD), e.g. a hearing aid, comprise a forward path comprising an input transducer (IT) for converting an input sound (Acoustic input) to an electric input signal (IN) representing sound, and an output transducer (OT) for converting a processed electric output signal (RES) to an output sound (Acoustic output), and a signal processing unit (SPU in FIG. 4B, 4C) operationally coupled to the input and output transducers and configured to apply a requested forward gain to the electric input signal or a signal originating therefrom. The forward path is configured to apply a resulting forward gain to the electric input signal and provides a resulting signal RES. The hearing device (HD) further comprises a feedback reduction unit (FBRU in FIG. 4B, 4C) for reducing a risk of howl due to acoustic or mechanical feedback of an external feedback path (FBP) from the output transducer (OT) to the input transducer (IT). Together, the forward path and the external feedback path defines a loop path exhibiting a roundtrip loop delay $T_{loop}$. The feedback reduction unit (FBRU in FIG. 4B, 4C) is configured to modulate the requested forward gain in time, to provide that the resulting forward gain exhibits a first gain $A_H$ in a first time period $T_H$ and a second gain $A_L$ in a second time period $T_L$, wherein at least the second time period $T_L$ is determined in dependence of the roundtrip loop delay $T_{loop}$. Preferably, the first (increased) gain $A_H$ is larger than 1, and the second (reduced) gain $A_L$ is smaller than 1. Preferably, the gain modulation (including the first and second time periods ($T_H$, $T_L$) and the first and second gains ($A_H$, $A_L$)) is adapted to conserve energy in the resulting signal compared to the signal before the modulation.

FIG. 4A schematically illustrates an implementation of the basic function of the feedback reduction unit (FBRU in FIG. 4B, 4C), in FIG. 4A represented by the block denoted Monitor signal and make gain adjustments and the respective combination unit (here multiplication units 'x' in each frequency band). A gain modulation is determined (e.g. predetermined or dynamically, e.g. based on an analysis of the current input signal and/or on one or more detectors, e.g. of the current environment, e.g. a feedback detector) and applied in each frequency band, e.g. by multiplication on to the respective band specific signal of the forward path, cf. e.g. FIG. 3 and discussion thereof. The forward path may comprise one or more processing units (cf. e.g. FIG. 4B, 4C) for applying frequency and level dependent gains to the electric input signal or a signal derived therefrom to provide an enhanced signal (e.g. to compensate for a users' hearing impairment, a noisy environment, etc.).

FIG. 4B shows a hearing device (HD) comprising a forward path comprising an input transducer IT providing an electric input signal IT in the time domain, and an analysis filter bank (FBA) providing the electric input signal IN in a number of frequency bands (e.g. 4 or 8 or 64) as band split electric input signal IN-F. The forward path further comprises a signal processing unit (SPU) operationally coupled to the analysis filter bank (FBA) and configured to apply a requested forward gain to the band split electric input signal IN-F and to provide an enhanced band split signal ENHS-F. The forward path further comprises a feedback reduction unit (FBRU) for applying a gain modulation to the enhanced band split signal ENHS-F and providing a resulting band split signal RES-F with a reduced risk of creating feedback (i.e. reducing a risk of creating howl due to acoustic or mechanical feedback from the output to the input transducer). The forward path further comprises a synthesis filter bank (FBS) for generating a resulting time domain signal RES from the enhanced band split signal ENHS-F. The synthesis filter bank (FBS) is operationally coupled to an output transducer (OT, e.g. a loudspeaker or a vibrator) for converting the resulting time domain signal RES to an acoustic or vibrational stimulus for presentation to a user of the hearing device.

FIG. 4C shows an embodiment of a hearing device as shown in FIG. 4B further comprising a conventional feedback cancellation system (comprising an electric feedback loop comprising 1) a feedback estimation unit (FBE) and 2) a combination unit ('+') located in the forward path in combination with a feedback reduction unit (FBRU) as described in the present disclosure. The feedback estimation unit (FBE) provides a feedback estimate signal fbp, which is subtracted from the electric input signal IN in the combination unit ('+'), and a resulting feedback corrected input (reference) signal ref is fed to the signal processing unit (SPU) and to the feedback estimation unit (FBE). The embodiment of FIG. 4C is similar to the embodiment of FIG. 1D (which may operate in the time domain) apart from the fact that a part of the forward path (comprising units SPU (signal processing unit) and FBRU (feedback reduction unit)) is operating in the (time-) frequency domain in the embodiment of FIG. 4C. In the embodiment of FIG. 4C, the feedback cancellation system (including feedback estimation unit (FBE) and combination unit ('+')) is operated in the time domain. It may alternatively be operated fully or partially in the (time-) frequency domain.

FIG. 5A shows a forward path (Forward Path) and a feedback path (Feedback Path) of a hearing device (HD) and a corresponding loop delay (Loop delay) comprising a sum of the propagation delays of the forward and feedback paths. The loop delay may be relatively constant over time (and e.g. determined in advance of operation of the hearing device) or be different at different points in time, e.g. depending on the currently applied algorithms in the signal processing unit.

Figure 5B:
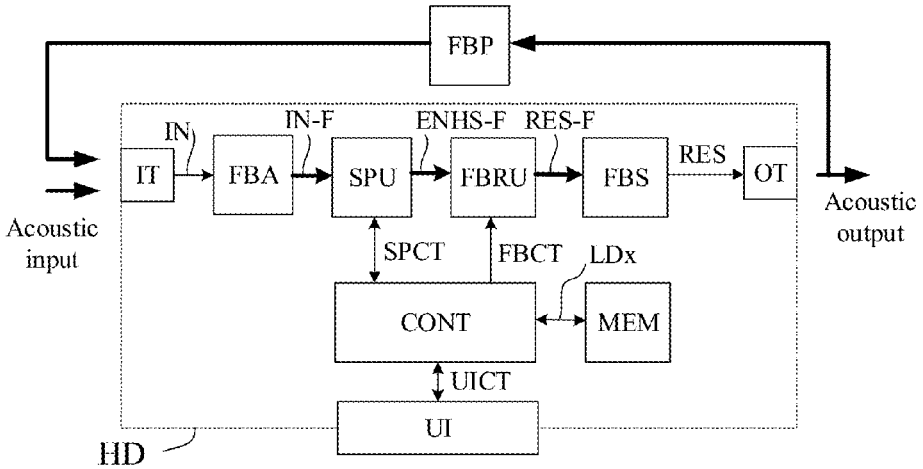

FIG. 5B shows an embodiment of a hearing device (HD) according to the present disclosure comprising a loop delay estimation unit and a user interface. FIG. 5B shows an embodiment of a hearing device (HD) according to the present disclosure as shown in FIG. 4B further comprises a control unit (CONT) for estimating a current loop delay or a deviation from a typical loop delay. The hearing device (HD) further comprises a memory unit (MEM) wherein typical loop delays (signal LDx) in different modes of operation of the hearing device are stored. In an embodiment, the control unit is configured to measure a loop delay comprising a sum of a delay of the forward path and a delay of the feedback path. In an embodiment, a predefined test-signal is inserted in the forward path by the control unit (CONT), e.g. via signal SPCT to/from the signal processing unit (SPU), and its round trip travel time measured (or estimated), e.g. by identification of the test signal when it arrives in the forward path after a single propagation (or a known number of propagations) of the loop. In an embodiment, a typical loop delay is of the order of ms, e.g. around 10 ms. The hearing device (HD) further comprises a user interface (UI) allowing a user to control functionality of the hearing device, e.g. a mode of operation (e.g. to enter or exit a particular feedback cancellation mode of operation), via control signal UICT. Likewise, the user interface (and the hearing device) may be configured to present a current loop delay to the user (e.g. as selected or estimated by the control unit (CONT)).

In the examples above, two (repetitive) time periods ($T_1=T_H$, $T_2=T_L$) have been used to illustrate the concept of the present disclosure. Generally, more than two periods, i.e., $T_1, T_2, T_3, \ldots, A_1, A_2, A_3, \ldots$ may be used. In the embodiments illustrated in FIG. 2A, 2B, 2C, 3A, we utilize $A_L*A_H=(\sim=)\ 0$ to prevent feedback, but in principle one can use $A_1*A_2*A_3*\ldots*A_N=(\sim=)0$ to prevent feedback, where N is the number of periods (the examples illustrated above correspond to N=2). An example of an effective choice of N=3 would emerge by dividing $T_L$ into $T_1$ and $T_2$ and let $T_3=T_H$.

Figure 6:
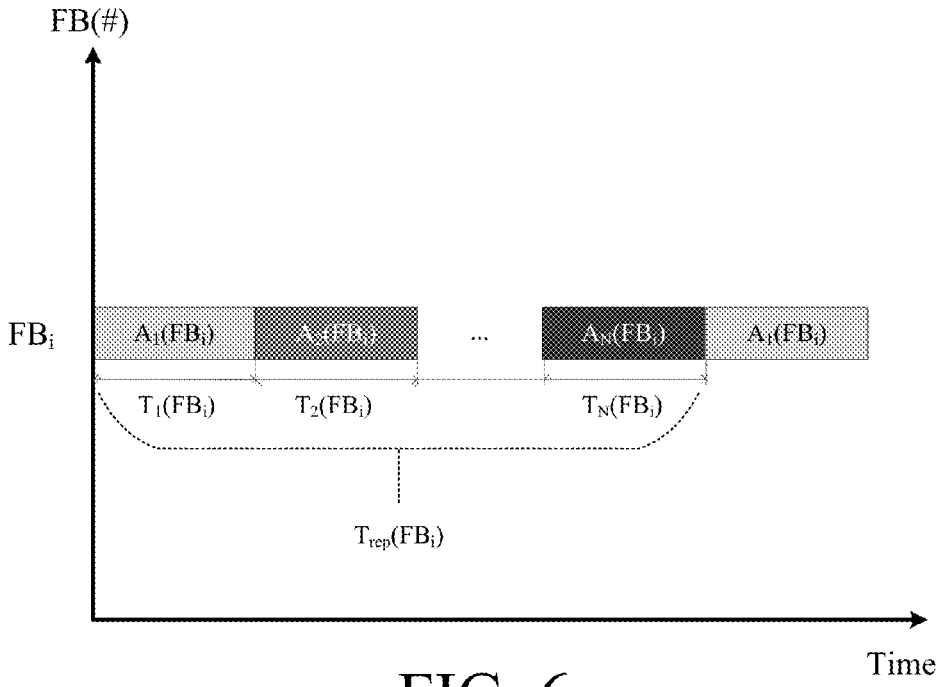
FIG. 6 illustrates a (repeated) gain pattern $A_1$, $A_2$, $A_3$, . . . , $A_N$, (for frequency band i, $FB_i$) comprising a multitude N of time periods $T_1$, $T_2$, $T_3$, . . . , $T_N$.

FIG. 6 shows the idea of having N time periods, each time period (of a given frequency band, $FB_i$) $T_1(FB_i)$, $T_2(FB_i)$, $T_3(FB_i), \ldots, T_N(FB_i)$ having a corresponding gain value of $A_1(FB_i), A_2(FB_i), \ldots, A_N(FB_i)$. FIG. 6 illustrates a repeated occurrence of the gain pattern $A_1, A_2, A_3, \ldots, A_N$, (for frequency band i, $FB_i$), wherein the repetition time $T_{rep}$ (or cycle time), defined by $T_{rep}=T_1+T_2+T_3+\ldots+T_N$. The gain pattern (and corresponding time periods) is preferably configured to conserve energy in the resulting signal compared to the signal before the modulation of the requested forward gain (e.g. on a cycle-time basis or over a longer or shorter time period depending on the application). In the examples illustrated in FIG. 2, 3 above, N=2, the time domain signal (the wideband signal), some of the frequency bands, or each frequency band exhibiting 2 time periods $T_1(FB_i)$, $T_2(FB_i)$, and 2 corresponding gain values (or functions) $A_1(FB_i)$ and $A_2(FB_i)$, which we have referred to as $T_H(FB_i)$, $T_L(FB_i)$, $A_H(FB_i)$ and $A_L(FB_i)$, respectively in connection with FIG. 2, 3. In these examples, the repetition time is given by $T_{rep}(FB_i)=T_H(FB_i)+T_L(FB_i)$. For N=3, to achieve similar feedback elimination effect as N=2, one could e.g. choose $T_1(FB_i)=T_H(FB_i)/2$, $T_2(FB_i)=T_H(FB_i)/2$, $T_3(FB_i)=T_L(FB_i)$, and $A_1(FB_i)=A_H(FB_i)*\mathrm{sqrt}(0.5)$, $A_2(FB_i)=A_H(FB_i)*\mathrm{sqrt}(1.5)$, $A_3(FB_i)=A_L(FB_i)$ (or e.g. any other combination of parameters that ensure energy conservation, if energy conservation is desired). The mentioned exemplary values of time and gain parameters for N=3 provide identical $T_{rep}(FB_i)$ and energy during one repetition of $T_{rep}(FB_i)$ as exemplified for N=2. That is, $T_{rep}(FB_i)=T_1(FB_i)+T_2(FB_i)+T_3(FB_i)=T_H(FB_i)+T_L(FB_i)$, and the energy over one repetition (cycle) $T_1(FB_i)*(A_1(FB_i))^2+T_2(FB_i)*(A_2(FB_i))^2+T_3(FB_i)*(A_3(FB_i))^2=T_H(FB_i)/2*(A_H(FB_i)*\mathrm{sqrt}(0.5))^2+T_H(FB_i)/2*(A_H(FB_i)*\mathrm{sqrt}(1.5))^2+T_L(FB_i)*A_L(FB_i)^2]=T_H(FB_i)*A_H(FB_i)^2+T_L(FB_i)*A_L(FB_i)^2$.]

In conclusion, a hearing device, e.g. a hearing aid, is provided, comprising a forward path comprising an input transducer for providing an electric input signal, a signal processing unit configured to apply a requested forward gain to the electric input signal, and an output transducer. The hearing device further comprises a feedback reduction unit for reducing a risk of howl due to feedback from the output transducer to the input transducer. The forward path and the external feedback path defines a roundtrip loop delay. The feedback reduction unit is configured to modulate said requested forward gain in time, to provide that the resulting forward gain exhibits a first, increased gain $A_H$ in a first time period $T_H$ and a second, reduced gain $A_L$ in a second time period $T_L$, wherein at least one of $A_H$, $A_L$, $T_H$, and $T_L$ is/are determined according to a predetermined or adaptively determined criterion including said roundtrip loop delay.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP2148527A1 (OTICON) 27.01.2010

US2015011266A1 (SENNHEISER COMMUNICATIONS) 08.01.2015

[Schaub; 2008] Arthur Schaub, Digital hearing Aids, Thieme Medical. Pub., 2008.

The invention claimed is:

1. A hearing device, e.g. a hearing aid, comprising an input transducer for converting an input sound to an electric input signal representing sound, an output transducer for converting a processed electric output signal to an output sound or mechanical vibration, and a signal processing unit operationally coupled to the input and output transducers and configured to apply a requested forward gain to the electric input signal or a signal originating therefrom, the input transducer, the signal processing unit and the output transducer forming part of a forward path of the hearing device, the forward path applying a resulting forward gain to the electric input signal and providing a resulting signal, the hearing device further comprising a feedback reduction unit for reducing a risk of howl due to acoustic or mechanical feedback of an external feedback path from the output transducer to the input transducer, the forward path and the external feedback path defining a loop path exhibiting a roundtrip loop delay, wherein the feedback reduction unit is configured to modulate said requested forward gain in time, to provide that the resulting forward gain exhibits a first, increased gain $A_H$ in a first time period $T_H$ and a second, reduced gain $A_L$ in a second time period $T_L$, wherein at least one of the first gain $A_H$, the second gain $A_L$, the first time period $T_H$, and the second time period $T_L$ is/are determined according to a predetermined or adaptively determined criterion, and wherein said criterion comprises that said first $T_H$ and/or said second $T_L$ time period is determined in dependence of said, possibly averaged, roundtrip loop delay of the forward path and the external feedback path.

2. A hearing device according to claim 1 wherein the modulation of the requested forward gain provided by the feedback reduction unit exhibits a predetermined or adaptively determined gain pattern over time with predefined and/or adaptively determined and adjusted gains $A_1$, $A_2$, $A_3$, . . . , $A_N$ in corresponding time periods $T_1$, $T_2$, $T_3$, . . . , $T_N$.

3. A hearing device according to claim 2 wherein the applied gain pattern comprises repeated occurrence of the predefined gain pattern $A_1$, $A_2$, $A_3$, . . . , $A_N$, wherein the repetition time (or cycle time) is $T_1+T_2+T_3+ \ldots +T_N$.

4. A hearing device according to claim 1 wherein said criterion comprises that the second time period $T_L$ is selected either similar to or smaller than the loop delay or an averaged round trip loop delay $T_{loop}$ or selected in relation to the loop delay by $T_{100p}/2<T_L<T_{loop}*2$.

5. A hearing device according to claim 1 comprising a control unit for estimating a current loop or average loop delay or a deviation from a typical loop delay or a typical average loop delay.

6. A hearing device according to claim 1 wherein said criterion comprises that the first and second time periods and the first and second gains are configured to conserve energy in the resulting signal compared to the signal before said modulation of said requested forward gain.

7. A hearing device according to claim 1 configured to provide that the increased gain $A_H$ and/or the reduced gain $A_L$ is/are variable during said first and second time periods $T_H$, and $T_L$.

8. A hearing device according to claim 1 comprising a time to time-frequency conversion unit for providing the electric input signal or a signal derived therefrom in a number of frequency bands.

9. A hearing device according to claim 1 configured to provide that the gain modification over time is performed in one or more selected or all frequency bands.

10. A hearing device according to claim 9 adapted to provide that said increased gain $A_H$ and/or said reduced gain $A_L$ is/are configurable for at least some of the frequency bands.

11. A hearing device according to claim 9 adapted to provide that said increased gain $A_H$ said reduced gain $A_L$ are only applied in frequency bands expected to be at risk of howl.

12. A hearing device according to claim 9 adapted to provide that said increased gain $A_H$ said reduced gain $A_L$ are only applied in frequency bands above a first threshold frequency, $f_{THL}$.

13. A hearing device according to claim 1 comprising a hearing aid, a headset, an active ear protection system or a combination thereof.

14. A method of operating a hearing device comprising a forward path for applying a resulting forward gain to an electric input signal and providing a resulting signal, the method comprising providing an electric input signal representing sound;

applying a requested forward gain to the electric input signal or a signal originating therefrom and providing a processed signal;

providing a resulting signal for conversion to an output sound; and reducing a risk of howl due to acoustic or mechanical feedback of an external feedback path leaking the output sound to the input sound by modulating said requested forward gain in time, to provide that the resulting forward gain exhibits a first, increased gain $A_H$ in a first time period $T_H$ and a second, reduced gain $A_L$ in a second time period $T_L$, and providing that at least one of the first gain $A_H$, the second gain $A_L$, the first time period $T_H$, and the second time period $T_L$ is/are determined according to a predetermined or adaptively determined criterion, wherein the predetermined criterion comprises that the first $T_H$ and/or the second $T_L$ time period is determined in dependence of a, possibly averaged, roundtrip loop delay of the forward path and the external feedback path.

15. A method according to claim 14 comprising providing that the first and/or the second time period is larger than or equal to the loop delay.

16. A method according to claim 14 comprising providing that the first and second time periods and the first and second gains are configured to conserve energy in the resulting signal compared to the signal before said modulation of said requested forward gain.

17. A method according to claim 14 wherein at least one of said first, increased gain $A_H$, said first time period $T_H$, said second, reduced gain $A_L$, and said second time period $T_L$, is/are selected using a model of human auditory perception in order to make said modulation of the requested forward gain less audible or even inaudible to the user.

18. A data processing system comprising a processor and program code means for causing the processor to perform the steps of the method of claim 14.

* * * * *